US010557327B2

(12) United States Patent
Clemens et al.

(10) Patent No.: US 10,557,327 B2
(45) Date of Patent: Feb. 11, 2020

(54) BRIDGE PLUGS

(71) Applicant: HALLIBURTON ENERGY SERVICES, INC., Houston, TX (US)

(72) Inventors: Jack Clemens, Fairview, TX (US); David Larimore, Dallas, TX (US); Mark Holly, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/749,452

(22) PCT Filed: Sep. 22, 2016

(86) PCT No.: PCT/US2016/053072
§ 371 (c)(1),
(2) Date: Jan. 31, 2018

(87) PCT Pub. No.: WO2018/056982
PCT Pub. Date: Mar. 29, 2018

(65) Prior Publication Data

US 2019/0010780 A1 Jan. 10, 2019

(51) Int. Cl.
*E21B 33/128* (2006.01)
*E21B 17/10* (2006.01)
*E21B 33/129* (2006.01)

(52) U.S. Cl.
CPC ..... *E21B 33/128* (2013.01); *E21B 17/1021* (2013.01); *E21B 33/1293* (2013.01)

(58) Field of Classification Search
CPC .. E21B 33/134; E21B 33/128; E21B 33/1293; E21B 17/1021
See application file for complete search history.

(56) References Cited

U.S. PATENT DOCUMENTS 7,690,437 B2 * 4/2010 Guillot ..... E21B 33/1208 166/177.2
8,555,959 B2 * 10/2013 Clemens ..... E21B 23/01 166/134

* cited by examiner

*Primary Examiner* — Kristyn A Hall
(74) *Attorney, Agent, or Firm* — Locke Lord LLP

(57) ABSTRACT

A bridge plug for a well includes an actuator member that moves from a first position such that the bridge plug is in a retracted position and a second position such that the bridge plug is in a deployed position. The bridge plug includes a slip section comprising one or more slips that grip a surface radially outward of the bridge plug in the deployed position and a petal section positioned downward of and adjacent to the slip section, the petal section comprising a plurality of petals that fan radially outward from the bridge plug in the deployed position to catch a slurry. The bridge plug also includes a centralizer section positioned downward of and adjacent to the pedal section, the centralizer section having a plurality of centralizers that ramp outwardly in an upward direction in the deployed position for centralizing the bridge plug.

14 Claims, 4 Drawing Sheets

BRIDGE PLUGS

BACKGROUND

1. Field

The present disclosure relates to bridge plugs and similar downhole tools and more specifically to through-tubing bridge plugs having low cost and high expansion that can be run and set using non-explosive, battery powered electro-mechanical setting tools.

2. Description of Related Art

Oil and gas wells are sometimes closed off, for example, when a lower zone of a well becomes non-productive, but one or more upper zones continue to be productive. A bridge plug provides a convenient way to seal off the zones from one another. The bridge plug may be set at a desired location within the well casing to isolate the zones of the well. Bridge plugs may be permanent or they may be retrievable. A retrievable bridge plug is typically used for certain drilling and workover operations to provide a temporary separation of zones. Permanent bridge plugs may be used when it is preferable to permanently close off a portion of the well.

One common type of permanent bridge plug is a "through tubing" bridge plug, or "thru tubing" bridge plug. The through-tubing bridge plug, as the name suggests, is lowered through a tubing string via a slickline, wireline, coiled tubing, or similar conveyance. The through-tubing bridge plug may then be set by axially compressing one or more packing elements on the bridge plug. The axial compression of the packing elements forces them to expand radially outward to contact the inner surface of the casing and thereby seal off a portion of the well.

Because through-tubing bridge plugs are passed through a tubing string, conventional through-tubing bridge plugs have a small outer diameter, which limits the extent to which the bridge plugs can radially expand. A larger expansion generally requires the through-tubing bridge plug to have a longer length, which in turn necessitates a setting tool with longer stroke (i.e., axial displacement), as long as 75 inches or more in some cases. Additionally, conventional through-tubing bridge plugs often employ an explosive charge to provide a sufficiently powerful force to actuate the bridge plugs, which requires special precaution and handling. Thus, in short, conventional through-tubing bridge plugs are large, expensive, and require powerful setting tools to operate.

Accordingly, a need exists for a through-tubing bridge plug that is low-cost, has high expansion, and can be operated using non-explosive, battery-powered setting tools.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
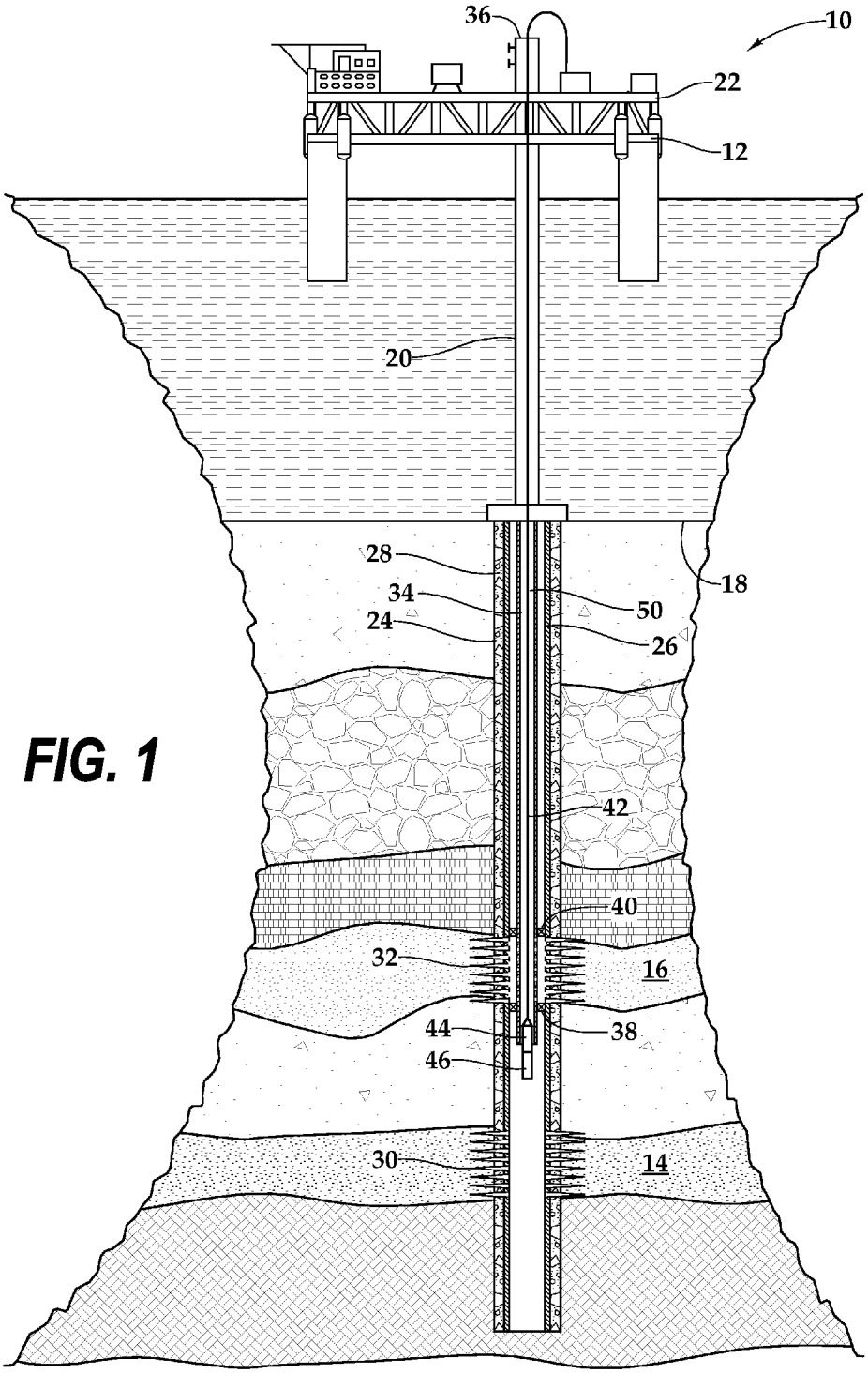
FIG. 1 is a schematic view of an oil or gas well in which a through-tubing bridge plug in accordance with this disclosure may be used.

As alluded to above, the embodiments disclosed herein provide a low-cost, high-expansion through-tubing bridge plug that can be run (i.e., in the retracted position) on a slickline, wireline, coiled tubing, and the like, and set (i.e., in the deployed position) using a conventional downhole power unit and an electro-mechanical setting tool instead of an explosive charge because a less powerful stroke is required to create a high-expansion seal. The downhole power unit may be a battery power unit in some embodiments and the setting tool may be a battery-powered electro-mechanical setting tool. Among other advantages, the through-tubing bridge plug may be used as a low-cost cement bridge that allows cement to be added and cured above the bridge plug to form a permanent plug.

Unlike traditional bridge plugs, the through-tubing bridge plug disclosed herein does not need a long stack of elastomeric seals that "climb" over each other to create a seal. As a result, a pull length of the actuator member is much shorter than conventional through-tubing bridge plugs which require setting tools with strokes longer than 75 inches, in some cases. As appreciated by those having ordinary skill in the art, the bridge plug 100 as described herein can be utilized in a system for well operations on a slickline, wireline, or any other suitable line. For example, a method includes setting a bridge plug on a slickline in a well. In certain embodiments, setting the bridge plug can include actuating an actuator member of the bridge plug over a pull length of less than 15 percent of the length of the bridge plug or any other suitable pull length.

Reference will now be made to the drawings wherein like reference numerals identify similar structural features or aspects of the subject disclosure.

Referring first to FIG. 1, an offshore oil or gas well 10 is shown in which a through-tubing bridge plug in accordance with the embodiments disclosed herein may be used. In a typical arrangement, the well 10 has a semi-submersible platform 12 centered over subterranean oil and gas formations 14, 16 located below the sea floor 18. A subsea conductor 20 extends from a deck 22 of the platform 12 to the sea floor 18 and through a wellbore 24 formed in the subterranean formations 14, 16. The wellbore 24 includes a casing 26 that is typically supported by a cement sheath 28. The casing 26 has two sets of perforations 30, 32 in the intervals proximate the oil and gas formations 14, 16.

A tubing string 34 extends from a wellhead 36 to a location below the gas formation 16 but above the oil formation 14 and provides a conduit for oil and/or gas to travel to the surface. Packers 38, 40 provide a seal between the tubing string 34 and the casing 26 to direct the flow of oil and/or gas from the formation 16 to the interior of the tubing string 34. Within the tubing string 34 is a slickline 42 used to convey a downhole power unit 44 and a through-tubing bridge plug 46. Even though the downhole power unit 44 and through-tubing bridge plug 46 are depicted as being deployed on a slickline, it is to be understood by those skilled in the art that the downhole power unit 44 and the bridge plug 46 may be deployed on other types of conveyances, including, but not limited to a wireline, coiled tubing, and the like, without departing from the scope of the disclosed embodiments.

In general operation, the through-tubing bridge plug 46 is run in a retracted configuration through the tubing string 34 until the bridge plug 46 reaches its target location in the wellbore 24. Once there, the through-tubing bridge plug 46 is set into its sealing configuration against the casing 26 using the downhole power unit 44 to seal off a portion of the wellbore 24 (e.g., the portion containing oil formation 14). The design of the bridge plug 46, as discussed further below, is such that no explosive charge is needed to actuate the bridge plug 46. Rather, a conventional electromechanical setting tool (not expressly shown) and the downhole power unit 44 may be used to actuate the bridge player 46. Any suitable downhole power unit 44 may be used, including a battery power unit, with the electromechanical setting tool. And by virtue of its innovative design, as discussed further below, the bridge plug 46 can achieve higher expansion then existing tools without requiring the setting tool to have a long stroke.

Note that although FIG. 1 depicts a vertical well, it should be understood by those skilled in the art that the through-tubing bridge plug disclosed herein is equally well-suited for use in deviated wells, inclined wells, horizontal wells, multilateral wells and the like. Likewise, although FIG. 1 depicts an offshore operation, it should be understood by those skilled in the art that the through-tubing bridge plug disclosed herein is equally well-suited for use in onshore operations. Following now are exemplary implementations of the through-tubing bridge plug 46 according to various aspects of this disclosure.

Figure 2A:
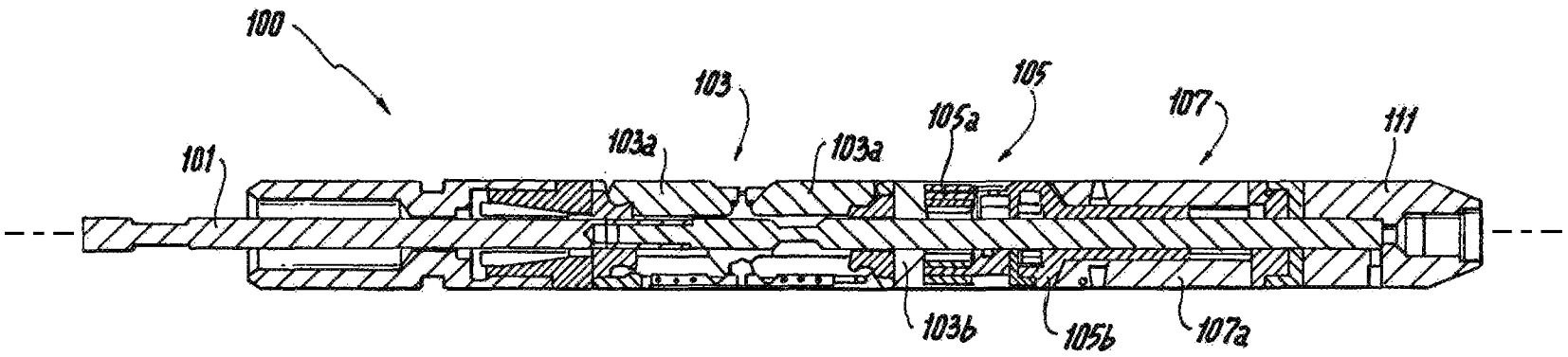
FIG. 2A is a cross-sectional view of an embodiment of the bridge plug in accordance with this disclosure, shown in a retracted position.
Figure 2B:
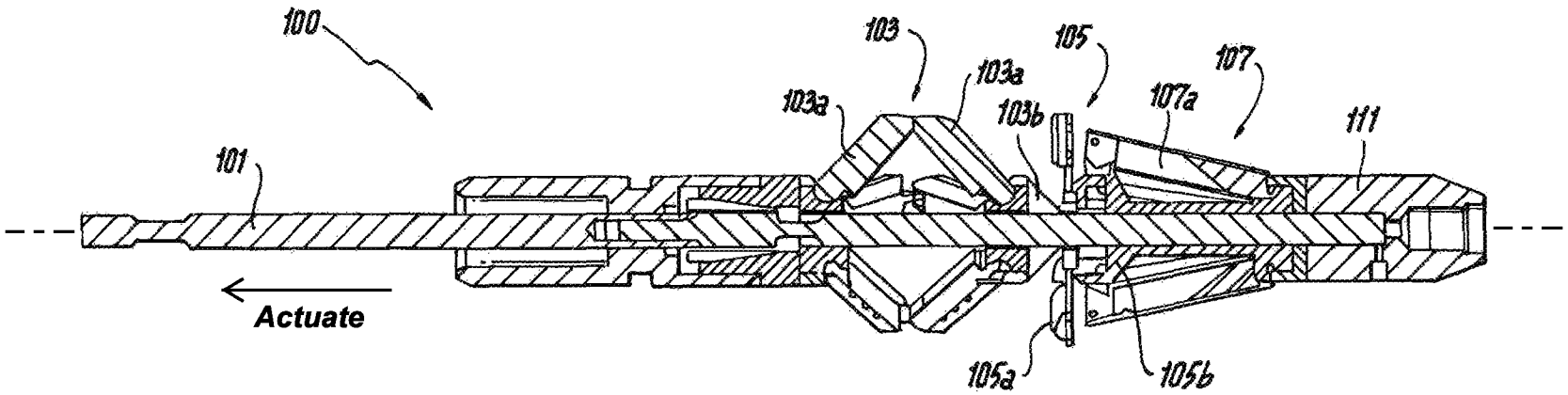
FIG. 2B is a perspective view of the embodiment of FIG. 2A, shown in a deployed position.
Figure 2C:
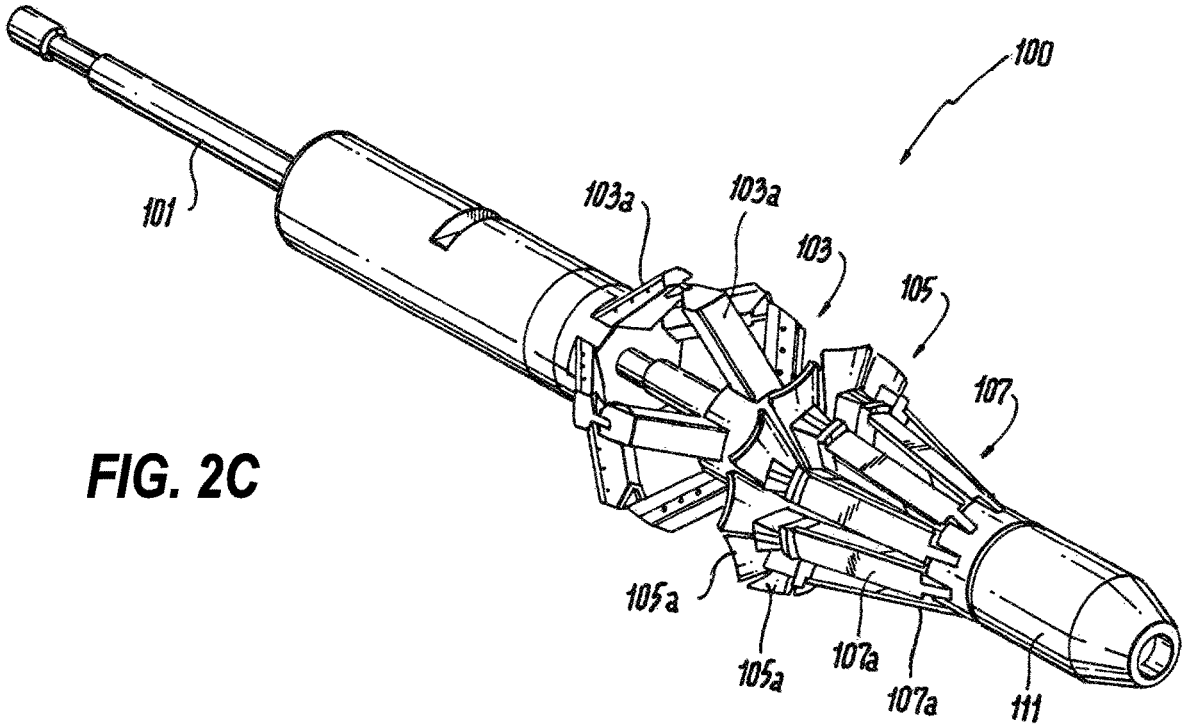
FIG. 2C is a cross-sectional view of the embodiment of FIG. 2A, shown in the deployed position.
Figure 2D:
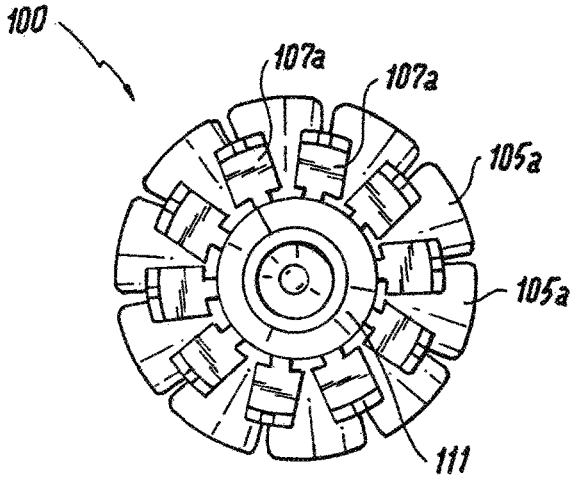
FIG. 2D is a plan view of a front of the embodiment of FIG. 2A, shown in the deployed position.

In accordance with at least one aspect of this disclosure, referring next to FIG. 2A, a through-tubing bridge plug 100 capable of being run within a tubing string includes a shaft like actuator member 101 operable to set or otherwise deploy the bridge plug 100. The actuator member 101 is designed to move between a first position as shown in FIG. 2A such that the bridge plug 100 is put in a retracted position, and a second position as shown in FIG. 2B such that the bridge plug 100 is put in a deployed position. For added clarity, FIG. 2C shows a perspective view of the bridge plug 100 in the deployed position and FIG. 2D shows a front plan view of the bridge plug 100 in the deployed position.

Referring still to FIG. 2A, the through-tubing bridge plug 100 includes a slip section 103 comprising a number of equally spaced slips 103*a* (e.g., five). Each slip 103*a* is designed to move between a retracted position as shown in FIG. 2A and a deployed position as shown in FIG. 2B. When in the deployed position, the slips 103*a* extend radially outwardly to grip the casing or wellbore, thereby anchoring or locking the bridge plug 100 in place. The slips 103*a* can be of any suitable shape and design and can be actuated in any suitable manner to extend outwardly, as appreciated by those having ordinary skill in the art. For example, as seen in FIG. 2B, the slips 103*a* may have a hinged design that may be actuated via an axial compression force on the hinged slips 103*a* in some embodiments.

The bridge plug 100 can also include a petal section 105 downward (to the right) of and adjacent to the slip section 103. The petal section 105 can include a plurality of individual petals 105*a* that, when deployed (e.g., by actuator member 101), fan radially outward from the bridge plug 100 to catch and hold slurry, concrete, and other operating material delivered down the casing and/or wellbore (e.g., to create a seal). The petal section 105 can allow for high expansion relative to the diameter of the plug 100 in a running configuration by virtue of having the folding pedals 105*a*. The pedals 105*a* can expand outwardly further than a traditional bridge plug elastomeric seal of the same length.

In certain embodiments, the petals 105*a* are hinged to the petal section 105, which allows them to rotate (at least partially) from a retracted or folded position (as shown in FIG. 2A) outwardly from a longitudinal axis (see dashed line) of the bridge plug 100 into a deployed or unfolded position (as shown in FIG. 2B). In certain embodiments, the petals 105*a* can also be doubly hinged such that the pedals 105*a* can rotate (at least partially) outwardly from the longitudinal axis of the bridge plug 100 as well as about a central axis of each petal 105*a* (e.g., for pitch of each petal 105*a* to change as the petals 105*a* deploy). As shown more clearly in FIG. 2B, the slip section 103 can include a downward ramp face 103*b* that, when deployed (e.g., by actuator member 101), force the petals 105*a* to unfold radially outward as the petal section 105 is pulled toward the ramp face 103*b*.

The petals 105*a*, which may have generally planar or slightly curved surfaces, can include any suitable shape, such as a radially inwardly tapering shape (as more easily seen in FIG. 2D) and other shapes appreciated by those skilled in the art. In the embodiment shown here, there are 10 petals 105*a*, but the specific number of petals may vary based on the particular shape and size of pedals and/or the size of the bridge plug 100. As well, the shape of the petals 105*a* should be selected so that, when deployed, the petals 105*a* minimize any gap between adjacent petals 105*a*, but do not interfere with each other when being put into the retracted position or into the deployed position. Similarly, the petals 105*a* can be made of any suitable material capable of withstanding downhole conditions and can have any radial length that allows the petals 105*a* to conform to the wall of the wellbore and/or casing.

A centralizer section 107 is also present on the bridge plug 100 downhole (to the right) of and adjacent to the pedal section 105. The centralizer section 107 has a plurality of individual centralizers 107*a* that, when deployed (e.g., by actuator member 101), help to center the bridge plug 100 within the casing and or wellbore. In the embodiment shown here, there are 10 centralizers 107*a*, but as with the pedals 105*a*, the specific number of centralizers may vary based on the size of the bridge plug 100. Each centralizer 107*a* can rotate from a retracted position as shown in FIG. 2A, outward from the longitudinal axis of the bridge plug 100, and downward into a deployed position, as shown in FIG. 2B. When deployed, the centralizers 107*a* are designed to ramp outwardly in an upward (left) direction such that the centralizers 107*a* extend progressively more radially outward in that direction and progressively less radially outward in the downward direction. The centralizers 107*a* can include any suitable shape, such as rectangular (as shown in FIGS. 2A and 2B), as appreciated by those skilled in the art. The petal section 105 can include a downward ramp portion 105*b* that, when deployed, is designed to drive under the centralizers 107*a* to force the centralizers 107*a* outward into the deployed position.

Figure 3A:
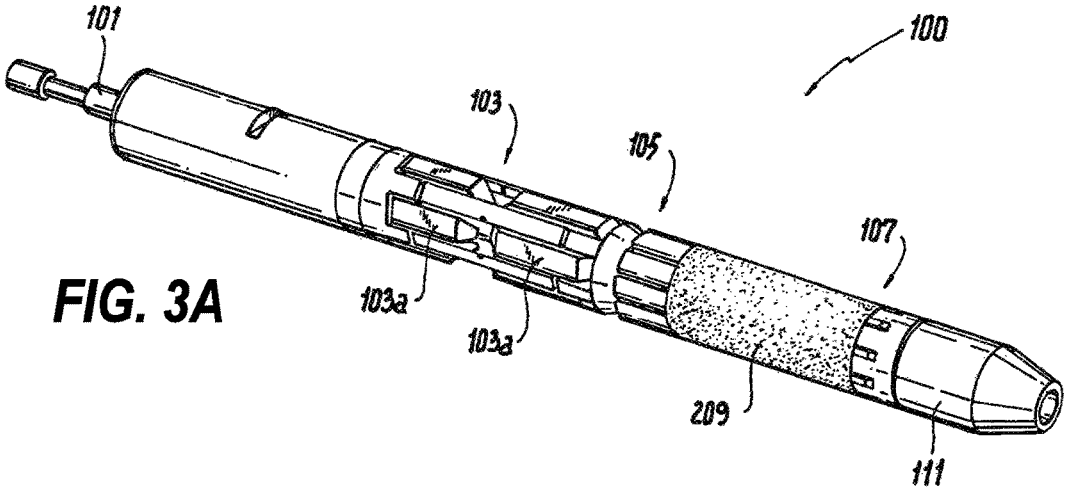
FIG. 3A is a perspective view of the embodiment of FIG. 2A, shown having a bag disposed over a centralizer section thereof and in the retracted position.
Figure 3B:
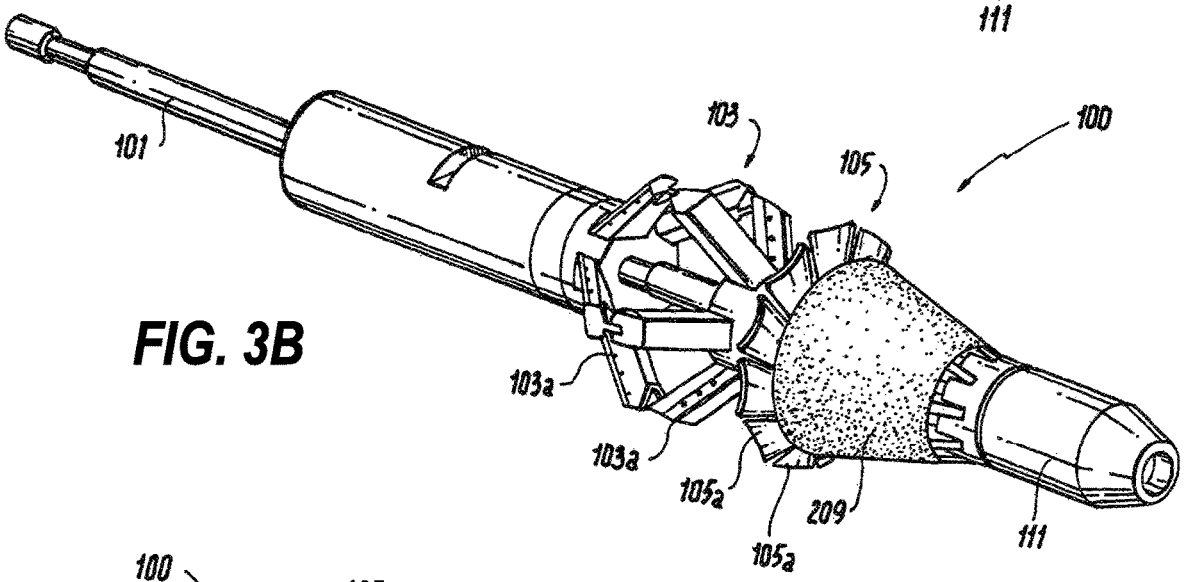
FIG. 3B is a perspective view of the embodiment of FIG. 2A, shown having a bag disposed over a centralizer section thereof and in the deployed position.
Figure 3C:
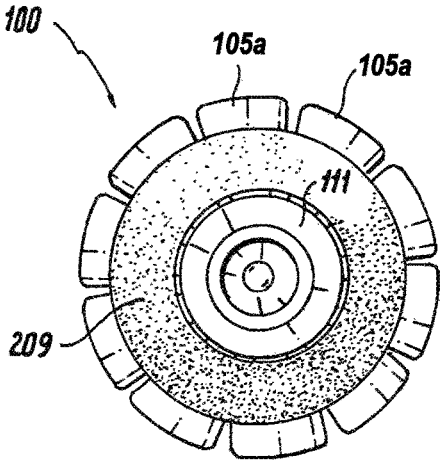
FIG. 3C is a plan view of the embodiment of FIG. 2A, shown having a bag disposed over a centralizer section thereof and in the deployed position.

In certain embodiments, referring to FIGS. 3A and 3B, the centralizer section 107 can include a polymer (e.g., elastomer) bag 209 disposed around the centralizers 107*a* to seal and protect the centralizers 107*a*. FIG. 3A shows the bridge plug 100, including the polymer bag 209, in the retracted position and FIG. 3B shows the bridge plug 100, including the polymer bag 209, in the deployed position. The polymer bag 209 can cover at least a portion of any gaps between individual centralizers 107*a* and improve the ability of the bridge plug 100 to catch slurry, cement, and other operating material. For example, referring to FIG. 3C, the bridge plug 100 is shown in plan view wherein the polymer bag 209 can be seen covering a radial area of the petals 105*a* in the deployed position.

Referring again to FIGS. 3A and 3B, as shown, the actuator member 101 can be a pull rod that can be pulled or otherwise moved (uphole) a pull distance between the first position (FIG. 3A) and the second position (FIG. 3B). In certain embodiments, the pull distance between the first position and the second position of the actuator member can be less than about 4.5 inches. The pull distance between the first position and the second position of the actuator member can be less than about 15 percent of a length of the bridge plug 100 in some embodiments. In certain embodiments, the pull distance between the first position and the second position of the actuator member can be less than about two times an outer diameter of the bridge plug 100 in the retracted position.

Referring to FIGS. 2A and 2B again, the actuator member 101 can be fixed to a tip member 111 at a downward end of the actuator member 101. As shown, the centralizer section 107 can be hingedly fixed to the tip member 111 such that the centralizers 107*a* hinge at the tip member 111. The slip section 103 and the petal section 105 can be slidably disposed on the actuator member 101 such that the slip section 103 (e.g., the downward ramp face 103*b*) pushes against the petal section 105 and the petal section 105 pushes against the centralizer section 107 to actuate the slips 103*a*, petals 105*a*, and the centralizers 107*a* radially outwardly to the deployed position.

In accordance with at least one aspect of this disclosure, a bridge plug for a well includes an actuator member that moves from a first position such that the bridge plug is in a retracted position and a second position such that the bridge plug is in a deployed position. The bridge plug includes a slip section comprising one or more slips that grip a surface radially outward of the bridge plug in the deployed position and a petal section positioned downward of and adjacent to the slip section, the petal section comprising a plurality of petals that fan radially outward from the bridge plug in the deployed position to catch a slurry. The bridge plug also includes a centralizer section positioned downward of and adjacent to the pedal section, the centralizer section having a plurality of centralizers that ramp outwardly in an upward direction in the deployed position for centralizing the bridge plug.

In accordance with at least one aspect or combination of aspects, the centralizer section can include a polymer bag disposed around the centralizers to seal the centralizers.

In accordance with at least one aspect of this disclosure or any combination thereof, the actuator member can be a pull rod that moves a pull distance between the first position and the second position.

In accordance with at least one aspect of this disclosure or any combination thereof, the pull distance between the first position and the second position of the actuator member can be less than about 4.5 inches.

In accordance with at least one aspect of this disclosure or any combination thereof, the pull distance between the first position and the second position of the actuator member can be less than about 15 percent of a length of the bridge plug.

In accordance with at least one aspect of this disclosure or any combination thereof, the pull distance between the first position and the second position of the actuator member can be less than about two times of an outer diameter of the bridge plug in the retracted position.

In accordance with at least one aspect of this disclosure or any combination thereof, the actuator member can be fixed to a tip member at a downward end of the actuator member.

In accordance with at least one aspect of this disclosure or any combination thereof, the centralizer section can be hingedly fixed to the tip member.

In accordance with at least one aspect of this disclosure or any combination thereof, the slip section and the petal section can be slidably disposed on the actuator member such that the slip section pushes against the petal section and the petal section pushes against the centralizer section to actuate the slips, petals, and the centralizers radially outwardly to the deployed position.

In accordance with at least one aspect of this disclosure or any combination thereof, a system for well operations includes a slickline and a bridge plug attached to the slickline, the bridge plug including an actuator member that moves from a first position such that the bridge plug is in a retracted position and a second position such that the bridge plug is in a deployed position, a slip section comprising one or more slips that grip a surface radially outward of the bridge plug in the deployed position, a petal section positioned downward of and adjacent to the slip section, the petal section comprising a plurality of petals that fan radially outward from the bridge plug in the deployed position to catch a slurry, and a centralizer section positioned downward of and adjacent to the pedal section, the centralizer section including a plurality of centralizers that ramp outwardly in an upward direction in the deployed position for centralizing the bridge plug.

In accordance with at least one aspect of this disclosure or any combination thereof, the centralizer section can include a polymer bag disposed around the centralizers to seal the centralizers.

In accordance with at least one aspect of this disclosure or any combination thereof, the actuator member can be a pull rod that moves a pull distance between the first position and the second position.

In accordance with at least one aspect of this disclosure or any combination thereof, the pull distance between the first position and the second position of the actuator member can be less than about 4.5 inches.

In accordance with at least one aspect of this disclosure or any combination thereof, the pull distance between the first position and the second position of the actuator member can be less than about 15 percent of a length of the bridge plug.

In accordance with at least one aspect of this disclosure or any combination thereof, the pull distance between the first position and the second position of the actuator member can be less than about two times of an outer diameter of the bridge plug in the retracted position.

In accordance with at least one aspect of this disclosure or any combination thereof, the actuator member can be fixed to a tip member at a downward end of the actuator member.

In accordance with at least one aspect of this disclosure or any combination thereof, the centralizer section can be hingedly fixed to the tip member.

In accordance with at least one aspect of this disclosure or any combination thereof, the slip section and the petal section can be slidably disposed on the actuator member such that the slip section pushes against the petal section and the petal section pushes against the centralizer section to actuate the slips, petals, and the centralizers radially outwardly to the deployed position.

In accordance with at least one aspect of this disclosure or any combination thereof, a method includes setting a bridge plug on a slickline in a well.

In accordance with at least one aspect of this disclosure or any combination thereof, setting the bridge plug can include actuating an actuator member of the bridge plug over a pull length of less than 15 percent of the length of the bridge plug.

The methods and systems of the present disclosure, as described above and shown in the drawings, provide for improved bridge plugs. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A bridge plug for a well, comprising:

an actuator member that moves from a first position such that the bridge plug is in a retracted position and a second position such that the bridge plug is in a deployed position;

a slip section comprising one or more slips that grip a surface radially outward of the bridge plug in the deployed position;

a petal section positioned downward of and adjacent to the slip section, the petal section comprising a plurality of petals that fan radially outward from the bridge plug in the deployed position to catch a slurry; and a centralizer section positioned downward of and adjacent to the petal section, the centralizer section including a plurality of centralizers, wherein each centralizer is hingedly fixed at a first end to a tip member positioned downward of the centralizer section such that the plurality of centralizers are adapted to rotate from a retracted position and ramp outwardly in an upward direction in the deployed position for centralizing the bridge plug within a wellbore or casing.

2. The bridge plug of claim 1, wherein the centralizer section includes a polymer bag disposed around the centralizers to seal the centralizers.

3. The bridge plug of claim 1, wherein the actuator member is a pull rod that moves a pull distance between the first position and the second position.

4. The bridge plug of claim 3, wherein the pull distance between the first position and the second position of the actuator member is less than about 4.5 inches.

5. The bridge plug of claim 3, wherein the pull distance between the first position and the second position of the actuator member is less than about 15 percent of a length of the bridge plug.

6. The bridge plug of claim 3, wherein the pull distance between the first position and the second position of the actuator member is less than about two times of an outer diameter of the bridge plug in the re-tracted position.

7. The bridge plug of claim 1, wherein the slip section and the petal section are slidably disposed on the actuator member such that the slip section pushes against the petal section and the petal section pushes against the centralizer section to actuate the slips, petals, and the centralizers radially outwardly to the deployed position.

8. The system of claim 1, wherein the slip section and the petal section are slidably disposed on the actuator member such that the slip section pushes against the petal section and the petal section pushes against the centralizer section to actuate the slips, petals, and the centralizers radially outwardly to the deployed position.

9. A system for well operations, comprising:

a slickline; and a bridge plug attached to the slickline, the bridge plug comprising:

an actuator member that moves from a first position such that the bridge plug is in a retracted position and a second position such that the bridge plug is in a deployed position;

a slip section comprising one or more slips that grip a surface radially outward of the bridge plug in the deployed position;

a petal section positioned downward of and adjacent to the slip section, the petal section comprising a plurality of petals that fan radially outward from the bridge plug in the deployed position to catch a slurry; and a centralizer section positioned downward of and adjacent to the pedal section, the centralizer section including a plurality of centralizers, wherein each centralizer is hingedly fixed at a first end to a tip member positioned downward of the centralizer section such that the plurality of centralizers are adapted to rotate from a retracted position and ramp outwardly in an upward direction in the deployed position for centralizing the bridge plug within a wellbore or casing.

10. The system of claim 9, wherein the centralizer section includes a polymer bag disposed around the centralizers to seal the centralizers.

11. The system of claim 9, wherein the actuator member is a pull rod that moves a pull distance between the first position and the second position.

12. The system of claim 11, wherein the pull distance between the first position and the second position of the actuator member is less than about 4.5 inches.

13. The system of claim 11, wherein the pull distance between the first position and the second position of the actuator member is less than about 15 percent of a length of the bridge plug.

14. The system of claim 11, wherein the pull distance between the first position and the second position of the actuator member is less than about two times of an outer diameter of the bridge plug in the retracted position.

* * * * *